US006273169B1

(12) United States Patent
Ono et al.

(10) Patent No.: US 6,273,169 B1
(45) Date of Patent: Aug. 14, 2001

(54) COATING FILM TRANSFER TOOL

(75) Inventors: Masahiko Ono; Koji Miki; Hiroshi Kozaki; Keiichiro Minegishi, all of Osaka-fu (JP)

(73) Assignee: Fujicopian Co., Ltd., Osaka (JP)

( * ) Notice: Subject to any disclaimer, the term of this patent is extended or adjusted under 35 U.S.C. 154(b) by 0 days.

(21) Appl. No.: 09/249,457

(22) Filed: Feb. 12, 1999

(30) Foreign Application Priority Data

Feb. 12, 1998 (JP) ..... 10-044224

(51) Int. Cl.[7] ..... B32B 31/00; B65H 20/26; B65H 23/00; B05C 17/00

(52) U.S. Cl. ..... 156/540; 156/577; 156/579; 118/257

(58) Field of Search ..... 156/540, 574, 156/577, 579; 118/257, 200, 106; D19/53, 69, 67

(56) References Cited

U.S. PATENT DOCUMENTS 5,556,469 9/1996 Koyama et al. ..... 118/257
5,772,840 * 6/1998 Morinaga ..... 156/540
5,820,728 * 10/1998 Stevens et al. ..... 156/577
6,112,796 * 9/2000 Stevens ..... 156/577
6,145,770 * 11/2000 Manusch ..... 242/422.4

FOREIGN PATENT DOCUMENTS

97/30922 * 8/1997 (WO) .

* cited by examiner

*Primary Examiner*—Richard Crispino
*Assistant Examiner*—Sue A. Purvis
(74) *Attorney, Agent, or Firm*—Quarles & Brady LLP

(57) ABSTRACT

A coating film transfer tool has a T-shaped transfer head with a pressing transfer part on the tip end thereof which protrudes from the main body and which is integrally formed with a pivot shaft that is rotatably mounted in the main body of the tool. Tape controlling members are formed on both lateral sides of the pressing transfer part along the edges of the tape only on the return side of the pressing transfer part, which is the side that the tape base material runs over after the coating film is transferred from it. The tape controlling members control the lateral movement of the tape base material, and do not interfere with the transfer tape upstream on the application side of the pressing transfer part, where the base material is coated with the coating film.

10 Claims, 6 Drawing Sheets

PRIOR ART (a)

PRIOR ART (b)

COATING FILM TRANSFER TOOL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a coating film transfer tool for transferring to a surface a coating film for correction, an adhesive, a decorative coating film or the like that is coated on the surface of a transfer tape base material.

2. Description of Related Art

A conventional coating film transfer tool is disclosed in Japanese Published Unexamined U.M. Application No. 13860/1995. This conventional coating film transfer tool basically has a structure as illustrated in FIG. 7(*a*) in which a transfer head 54 of this coating film transfer tool 50 can be rotated about the axis of a pivot shaft 60 (FIG. 7(*b*)) rotatably provided in a main body 52 (cassette). Further, the transfer head 54 is provided with tape guides 56, 56 for controlling the movement of the transfer tape T in the lateral direction (the direction of the width of the tape T) outside the main body.

A pressing transfer part 62 formed on the tip portion of the transfer head 54 and extending lengthwise in the lateral direction slightly protrudes from the ends of the tape guides 56, 56. The tape T passes over the application side of the pressing transfer part, which is the side facing the receiving surface, the laterally extending separating edge of the pressing transfer part 62, and then the return side (the upper side in FIG. 7(*a*)) of the pressing transfer part 62. The end edge of the pressing transfer part 62 is perpendicular to the axis of the shaft 62, about which the head 54 is rotatable.

A tape unreeling rotary part 51 upstream of the head 54 and a tape reeling rotary part 53, or take-up reel, downstream from the head 54 are rotatably provided in the main body 52.

The transfer tape T, which is coated with a coating film, is reeled around the tape unreeling rotary part 51 and passes over the pressing transfer part 62 protruding outside from the tape guides 56, 56 with its coated side facing outward. Prior to running over the return side of the pressing transfer part, the tape T is separated into the coating film transferred to a receiving surface and a remaining tape base material as the application side of the part 62 is pressed against and moved over the receiving surface, and only the tape base material is reeled around the tape reeling rotary part 53.

FIG. 7(*b*) is an enlarged perspective view of the main part of the coating film transfer tool 50 illustrated in FIG. 7(*a*). The transfer tape T is omitted in FIG. 7(*b*).

Triangular plate-shaped tape guides 56, 56 are formed on both sides of the transfer head 54 and, as described above, the pressing transfer part 62 protrudes from the tape guides 56, 56.

Therefore, when the pivot shaft 60 is rotated, the tape guides 56, 56 are also rotated about the same axis with respect to the main body 52.

While the transfer tape not shown is moved from the transfer head 54 to the pressing transfer part 62 to transfer the coating film to the surface to be transferred and then the remaining tape base material is returned from the transfer head 54 into the main body 52, the transfer tape T is guided by the triangular plate-shaped tape guides 56, 56. Thus, the position of the transfer tape T is regulated in the lateral direction.

When the coating film transfer tool 50 is used, the main body 52 is gripped by hand and the pressing transfer part 62 is moved in the direction shown by an arrow in FIG. 7(*a*) while it is pressed on the desired position of the surface to be transferred. Then, the tape unreeling rotary part 51 and the tape reeling rotary part 53 are rotated and the transfer tape T is unreeled from the tape unreeling rotary part 51 and is moved in the direction of the receiving surface and the coating film on the surface of the transfer tape T is transferred by the pressing transfer part 62 to the receiving surface. The remaining tape base material is reeled around the tape reeling rotary part 53.

Since the pressing transfer part 62 formed on the tip portion of the pivot shaft 60 is pivotally mounted on the main body 52, the transfer tape T guided by the tip portion of the pressing transfer part 62 is also twisted by the pivoting of the pressing transfer part 62.

Therefore, in the coating film transfer tool 50, even if the main body 52 is inclined to the surface to be transferred when the coating film is transferred to the surface to be transferred, the transfer head 54 is rotated and the transfer tape T is also twisted thereby and the whole width of the transfer tape T is uniformly put into close contact with the surface to be transferred, whereby the coating film can be correctly transferred to a desired location.

FIG. 8 is a cross-sectional view of the coating film transfer tool 50 taken on line 8—8 in FIG. 7. FIG. 8(*a*) illustrates a normal position in which the transfer head 54 is not rotated and the tape is not twisted and FIG. 8(*b*) illustrates a twisted position in which the transfer head 54 is rotated and the tape is twisted.

As illustrated in FIG. 8(*b*), this type of coating film transfer tool 50 can be difficult to transfer the coating film if the pivot angle of the head, and therefore the twist of the tape, is excessive. If the main body 52 is inclined excessively to the surface to be transferred and the pivot shaft 60 is rotated thereby, the tape guides 56, 56 formed on the transfer head 54 are also rotated and put into contact with the transfer tape T. This can hinder the transfer tape T from running, peel the coating film on the transfer tape T off from the tape base material, or detach the tape T from the pressing transfer part 62.

Further, the rotated tape guides 56, 56 may exert a strong force to the transfer tape T, whereby the tape T might be cut.

In this respect, in this type of coating film transfer tool, a strong force is applied to the bottom of the pressing transfer part 62 pressed on the surface to be transferred and hence the transfer tape T tends to be moved in the lateral direction when the user's hands are unsteady. However, in the conventional coating film transfer tool 50, as is evident in FIG. 7(*b*), the pressing transfer part 62 itself can not control the movement of the transfer tape T.

Since, this type of coating film transfer tool 50 has the pressing transfer part 62 on the axis of the pivot shaft 60, when it is used, a slant angle D (see FIG. 7(*a*)) made by the pressing transfer part 62 and the receiving surface is small. Distance P between the main body 52 and the receiving surface is also small, which makes it difficult to see the receiving surface ahead of the tool and, in particular, the end position of transfer.

Since the transfer head 54 has triangular plate-shaped guides on both sides to control the position of the transfer tape T, it is difficult to check the end position of transfer because the guides obstruct the view. Therefore, it is difficult to finish transferring the coating film correctly at a desired position.

Thus, it can be difficult to correctly erase particular letters in a printed sentence.

SUMMARY OF THE INVENTION

To solve the above-mentioned problems, the present invention provides a coating film transfer tool comprising an unreeling rotary part and a reeling rotary part that are rotatably received in a main body, a transfer tape to be separated into a coating film to be transferred to a receiving surface and a remaining tape base material via a transfer head, the tape base material being reeled around the reeling rotary part from the unreeling rotary part and the transfer head being rotated around an axis by a pivot shaft mounted in the main body. A pressing transfer part is formed on the tip portion of the transfer head which protrudes from the main body, and tape controlling members are provided only on the return side of the pressing transfer part, where the coating film has already been stripped from the tape base material. The application side is free of tape controlling members.

The tape controlling members formed on both lateral sides of the pressing transfer part are provided only on the return side of the pressing transfer part to prevent the tape base material of the transfer tape from moving in the lateral direction just after the coating film is transferred to the receiving surface. This way, the tape controlling members are not put into contact with the transfer tape having the coating film before transfer.

Further, the tape controlling members are formed on both ends of the pressing transfer part and are not formed in the back thereof. Therefore, even if the transfer head is rotated to a relatively high angle about the pivot axis of the pivot shaft, the tape base material is not put into forceful contact with the tape controlling members and hence does not hinder the transfer tape from running nor break the transfer tape. In addition the absence of tape controlling members on the application side does not obstruct viewing of the receiving surface.

If the tape controlling members are formed at a desired rising angle to the tape base material of the transfer tape, even if the turning head is turned to the main body to twist the transfer tape, the transfer tape does not ride up over the tape controlling member nor hinder the checking of the position of the transfer.

Still further, if the main body is provided with tape guides, the tape guides are not turned with respect to the main body. Therefore, the tape guides always control the position of the transfer tape in the direction of width thereof in a fixed relationship with the direction in which the transfer tape runs and hence do not hinder the transfer tape from running.

In addition, if the pressing transfer part is shifted in the direction of the surface to be transferred from the axis of the turning shaft, the main body is not aligned with the surface to be transferred to produce a larger space than ever between the main body and the surface to be transferred, whereby the end position of transfer can be more easily observed.

These and other objects and advantages of the invention will be apparent from the drawings and detailed description.

BRIEF DESCRIPTION OF THE DRAWINGS

FIG. 1(*b*) is an enlarged perspective view of the transfer head of FIG 1(*a*);

FIG. 1(*c*) is a longitudinal cross-sectional view taken on line c—c of FIG. 1(*a*);

FIG. 1(*d*) is a longitudinal cross-sectional view taken on line d—d (the axis of shaft 20) of FIG 1(*a*), with a modification to the shape of the members 30;

FIG. 7(*b*) is an enlarged perspective view of the main portion of the tool of FIG. 7(*a*);

FIG. 8(*b*) is a view like FIG. 8(*a*) but illustrating a state in which the transfer head is pivoted.

DETAILED DESCRIPTION OF THE PREFERRED EMBODIMENTS

Figure 1:
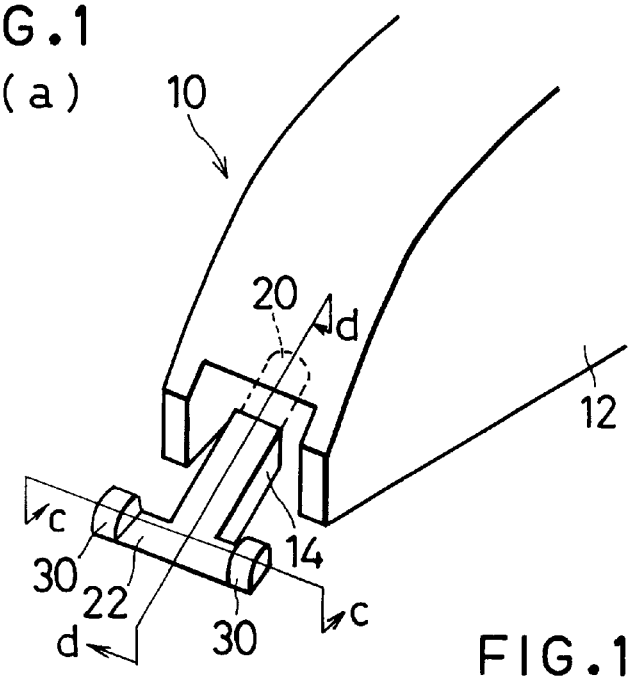
FIG. 1(*a*) is a perspective view of a main portion of a coating film transfer tool according to the present invention.
Figure 1:
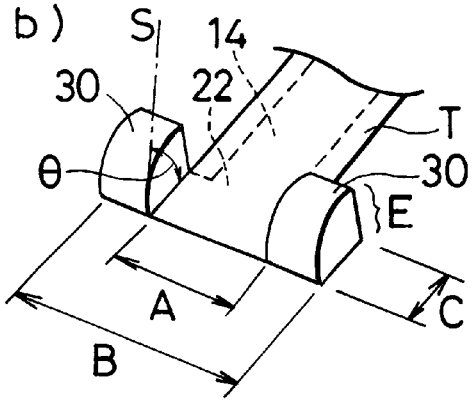
Figure 1:
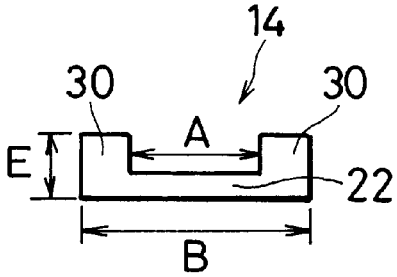
Figure 1:
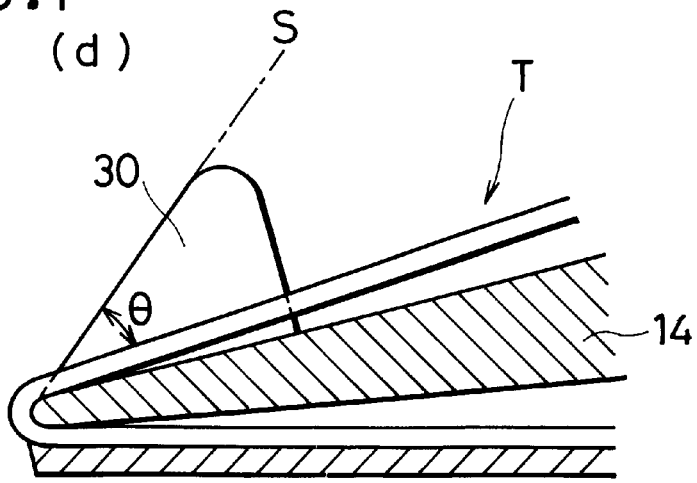

FIG. 1(*a*) is a perspective view of the main portion of a coating film transfer tool 10 according to the present invention, in which a transfer tape T is omitted, and FIG. 1(*b*) is a partial enlarged perspective view of the transfer head in FIG. 1(*a*) and illustrates a transfer tape T.

The structure and materials of the transfer tape T, the structure for rotatably mounting the transfer tape T on the coating film transfer tool, and the method for transferring a coating film to the receiving surface to be coated which are used in the coating film transfer tool 10 are the same as those used in the conventional coating film transfer tool. Therefore, these will not be described in detail here.

The coating film transfer tool 10 has a main body 12 and a T-shaped transfer head 14 integral with a pivot shaft 20 rotatably mounted on the main body 12 so that the T-shaped transfer head 14 is rotatable about the axis (line d—d) of the pivot shaft 20. This axis is also the longitudinal axis of the transfer head 14.

A pressing transfer part 22 formed on the tip of the transfer head 14 and extending lengthwise in the lateral direction protrudes from the main body 12, and tape controlling members 30, 30 having a quadrant-shaped cross section produced by dividing a relatively low-profile cylinder into four sections in the axial direction are formed on both lateral ends of the pressing transfer part 22, so that the base material with the coating film stripped from it resides between the members 30, 30. The members 30, 30 extend from the separating edge at the end of the pressing transfer part in the downstream direction, i.e., in the running direction of the tape toward the take-up reel.

FIG. 1(*c*) is a longitudinal cross-sectional view of the transfer head 14 taken on line c—c of FIG. 1(*a*). Since the tape controlling members 30, 30 are formed only on the return side of the pressing transfer part 22, which is the surface the tape base material runs over after transferring the coating material onto the receiving surface, they do not hinder the transfer tape T from being pressed onto the receiving surface. Further, even if the pivot shaft 20 is rotated a large angle from the normal position in which the tape is not twisted, so as to twist the transfer tape T with respect to the main body 12, the tape controlling members 30, 30 do not interfere with the coating film on the transfer tape T, since it has already been deposited on the receiving surface, so the coating film of the transfer tape T is not peeled off from the tape base material by the members 30, 30.

Further, the spacing A between two tape controlling members 30, 30 formed on the pressing transfer part 22 is made slightly larger than the width of the transfer tape T so that they do not hinder the transfer tape T from moving past them, add here When the coating film is transferred to the receiving surface while the main body 12 is being moved, even if a force from moving the transfer tape T in the direction of width of the tape T is applied to it, the movement of the tape base material remaining and turned over after transfer is positively controlled in the direction of width thereof, which results in controlling the movement of the transfer tape T contacting the receiving surface in the direction of width.

FIG. 1(*d*) is a longitudinal cross-sectional view of the transfer head 14 taken on line d—d in FIG. 1(*a*), and illustrates the transfer tape T not illustrated in FIG. 1(*a*).

The tape controlling members 30, 30 formed on the pressing transfer part 22 are formed such that an angle θ between the tape base material returning to the main body 12 after the coating film is transferred by the pressing transfer part 22 and a line S which extends from the end edge of the pressing transfer part 22 to the edge of the tape controlling members 30, 30 which is distal from the tape in the direction of thickness of the tape (angle θ is herein referred to as the rising angle of the tape controlling members 30) is 20 to 90 degrees.

As described above, if the rising angle θ of the tape controlling members 30, 30 to the transfer tape T base material is made 20 to 90 degrees, even if the turning angle of the transfer head 14 to the main body 12 is made larger in use, the transfer tape T does not run up over the tape controlling members 30, 30.

In this respect, the shape of the members 30 in FIG. 1(*d*) is more triangular plate shaped than cylindrical quadrant-shaped, but the effect is the same. Other shapes, for example a semi-cylindrical shape or a trapezoidal shape, may also be used with the same effect.

If the rising angle θ of the tape controlling members 30, 30 to the transfer tape T base material is less than 20 degrees, then when the turning angle of the transfer head 14 to the main body 12 is made larger, the transfer tape T may run up over one of the tape controlling members 30. If the rising angle θ is more than 90 degrees, the tape controlling members 30, 30 may obstruct a user's view of the transfer position.

Figure 2:
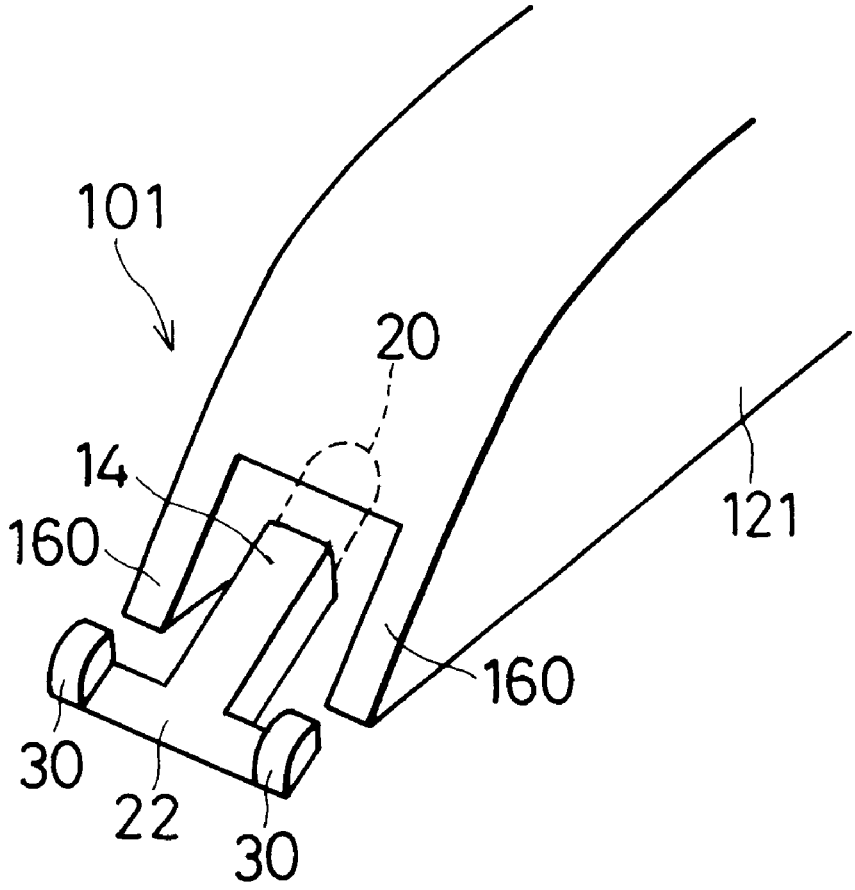
FIG. 2 is an enlarged perspective view of a main portion of a second embodiment of a coating film transfer tool according to the present invention.

FIG. 2 is an enlarged perspective view of the main portion of a coating film transfer tool 101 of a second embodiment according to the present invention.

Triangular plate-shaped tape guides 160, 160 extending along both sides of the transfer head 14 are formed integrally with the main body 121 of this coating film transfer tool 101.

The pressing transfer part 22 formed on the tip of the transfer head 14 protrudes slightly from the tape guides 160, 160 of the main body 121.

The structure other than the main body 121 used in this coating film transfer tool 101 is essentially the same as in the first embodiment, and the description thereof will not be repeated.

Since the coating film transfer tool 101 is provided with tape guides 160, 160 on the main body 121, the movement of the transfer tape T in the lateral direction can be further positively controlled, not only by the tape controlling members 30, 30 of the pressing transfer part 22, but also by the tape guides 160, 160.

Figure 3:
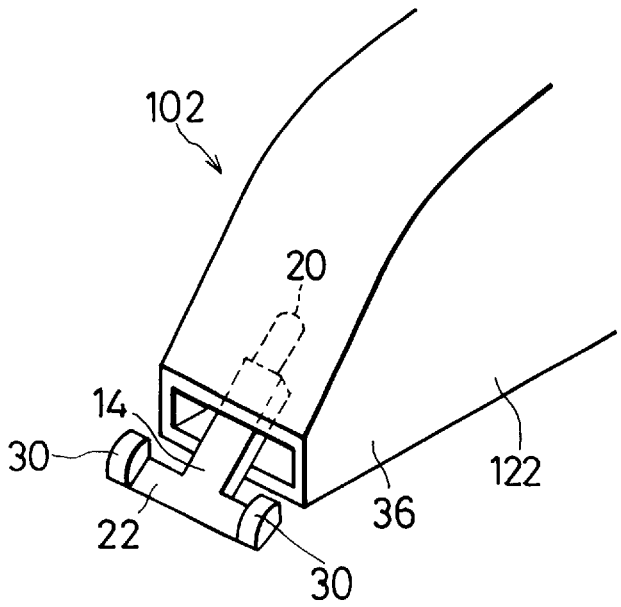
FIG. 3 is an enlarged perspective view of a main portion of a third embodiment of a coating film transfer tool according to the present invention.

Next, FIG. 3 is an enlarged perspective view of the main portion of a coating film transfer tool 102 of a third embodiment according to the present invention. The transfer tape T is omitted in the illustration.

A tape guide portion 36 having a rectangular cross section is integrally formed on the end portion of the main body 122 of the coating film transfer tool 102, and the transfer head 14 and the T-shaped pressing transfer part 22 protrudes outwardly from the rectangular opening of the tape guide portion 36.

The tape controlling members 30, 30 are formed on both ends in the lateral direction of the pressing transfer part 22.

The structure other than the main body 122 used in this coating film transfer tool 102 is essentially the same as in the first embodiment, so the description thereof will not be repeated.

In this respect, since the tape guide portion 36 is formed on the main body of the coating film transfer tool 102, the movement of the transfer tape T in the lateral direction can be further positively controlled not only by the tape controlling members 30, 30 of the pressing transfer parts 22 but also by the tape guide portion 36.

Figure 4:
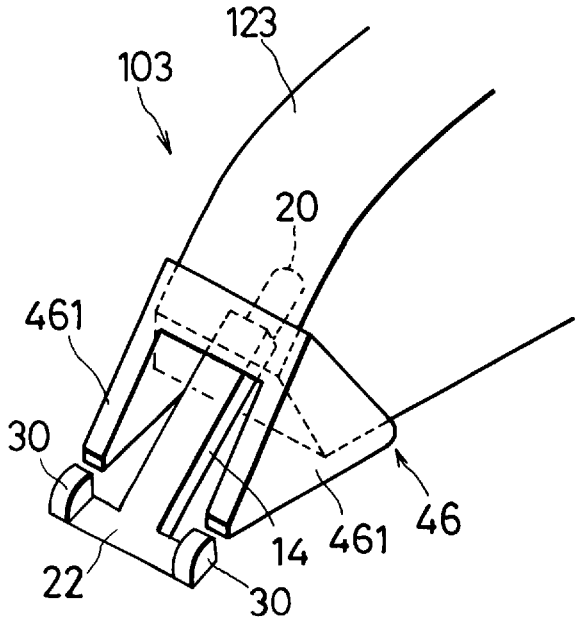
FIG. 4 is an enlarged perspective view of a main portion of a fourth embodiment of a coating film transfer tool according to the present invention.

Next, FIG. 4 is an enlarged perspective view of the main portion of a coating film transfer tool 103 of a fourth embodiment according to the present invention. The transfer tape T is omitted in the illustration.

In this coating film transfer tool 103, the structure other than the main body 123 and a tape guide described below is essentially the same as in the first embodiment, and the description thereof will not be repeated.

A tape guide 46 is removably mounted on the end portion of the main body 123 of the coating film transfer tool 103.

The tape guide 46 is provided with triangular plate-shaped guide portions 461, 461 on both sides thereof and the guide portions 461, 461 are integral with a root portion of a predetermined width. The width can be changed according to the thickness or the shape of the guide portions 461, 461 and is determined according to the width of the transfer tape T in use.

The transfer head 14 extends outwardly in the shape of the letter T from the tape guide 46 mounted on the end portion of the main body 123, and the pressing transfer part 22 formed on the tip of the transfer head 14 protrudes slightly from the tape guide 46. The tape controlling members 30, 30 are formed on both ends of the pressing transfer part 22.

The particular tape guide 46 used is chosen according to the width of the transfer tape in use. Other parts of the tool 103 can be used in common irrespective of the width of the transfer tape T.

Further, if the tape guide 46 is transparent, it is useful in checking the end position of transfer because the pressing transfer part 22 and the receiving surface can be seen through the tape guide 46.

As is described in the coating film transfer tools 101, 102, or 103, if the main body 121, 122, or 123 is provided with the tape guide or the tape guide portion 160, 36, or 46, the movement of the transfer tape T can be further positively controlled not only by the tape controlling members 30, 30 but also by the tape guide or the tape guide portion 160, 36 or 46.

Furthermore, since the tape guide or the tape guide portion 160, 36 or 46 is mounted on the main body 121, 122 or 123, even if the transfer head 14 and the pressing transfer part 22 are rotated relative to the main body to a twisted position, the tape guide or the tape guide portion 160, 36 or 46 is not put into significant or forcefil contact with the transfer tape T.

Figure 5:
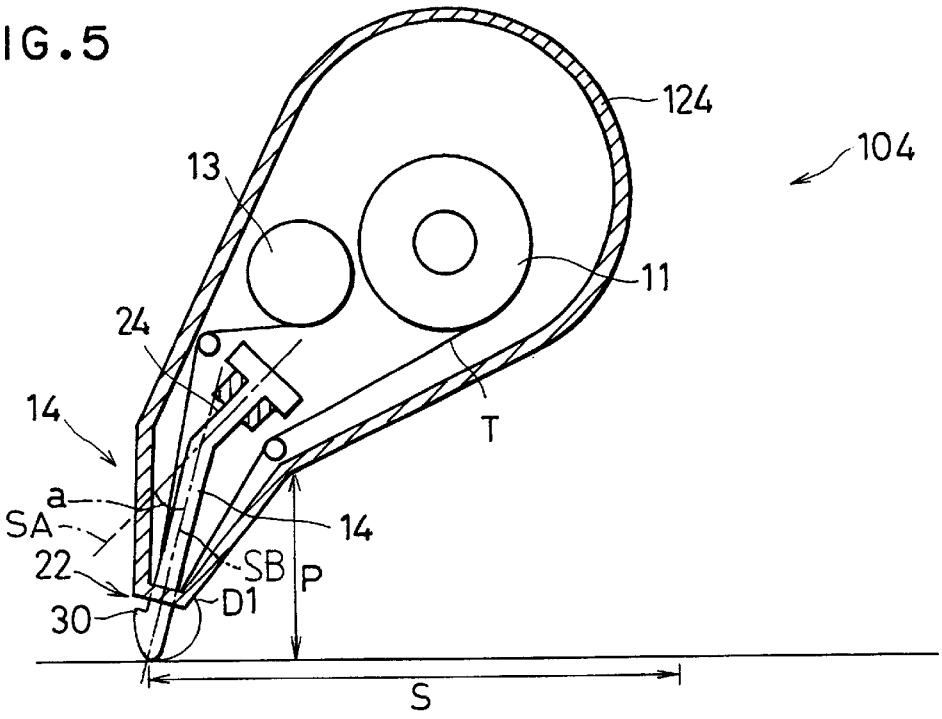
FIG. 5 is a longitudinal cross-sectional view of a fifth embodiment of a coating film transfer tool according to the present invention.

A coating film transfer tool 104 of a fifth embodiment according to the present invention is illustrated in FIG. 5.

The structure other than the pivot shaft 24 used in the coating film transfer tool 104 is essentially the same as in the first embodiment and the description thereof will not be repeated.

When viewed from the axis of the turning shaft 24, the position of the pressing transfer part 22 is shifted in the direction of the receiving surface. The center line of thickness of the pressing transfer part 22 is identified by axis SB and the axis of the pivot shaft 24 is identified by SA. The axis SB of part 22 is inclined toward the receiving surface by an angle $\alpha$ with respect to the axis SA. Therefore, the transfer head 14 itself is also inclined toward the receiving surface with respect to the main body 124.

An inclined angle D1 of the pressing transfer part 22 to the surface to be transferred and a distance P between the main body 124 and the surface to be transferred can be made larger as compared with the conventional coating film transfer tool. Therefore, a portion S of the receiving surface ahead of the part 22 yet to be coated can be easily checked.

Figure 6:
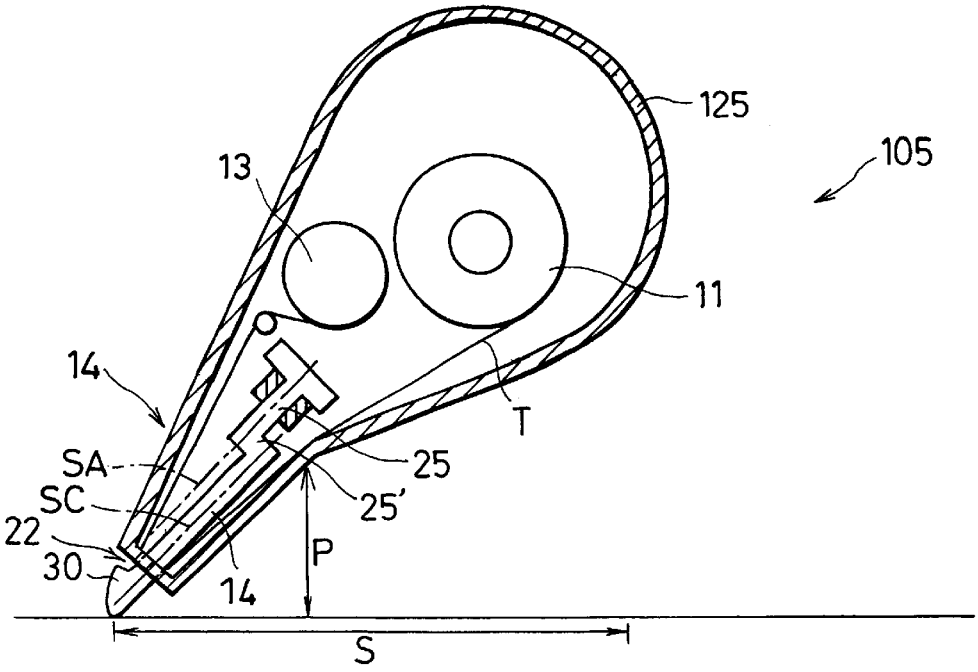
FIG. 6 is a longitudinal cross-sectional view of a sixth embodiment of a coating film transfer tool according to the present invention.
Figure 7:
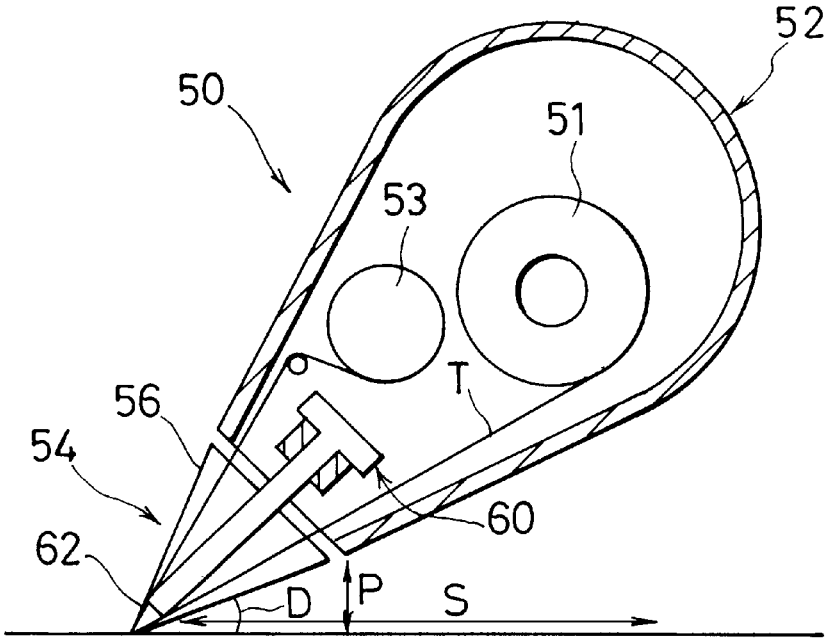
FIG. 7(*a*) is a longitudinal cross-sectional view of a conventional coating film transfer tool.
Figure 7:
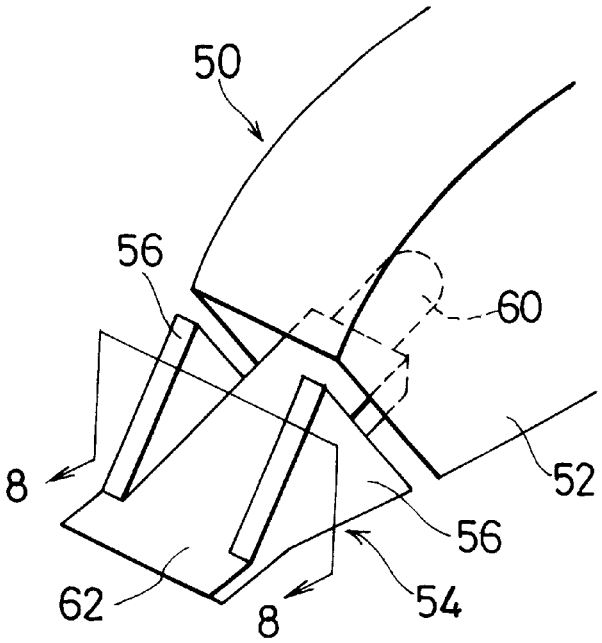
Figure 8:
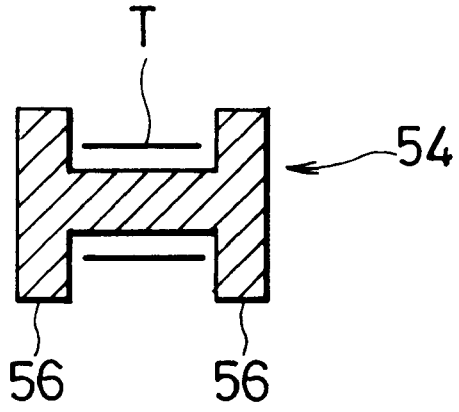
FIG. 8 PRIOR ART
FIG. 8(*a*) is a longitudinal cross-sectional view of the tool of FIGS. 7(*a*) and 7(*b*) taken on line 8—8 of FIG. 7(*b*), illustrating a state in which the transfer head is not pivoted.
Figure 8:
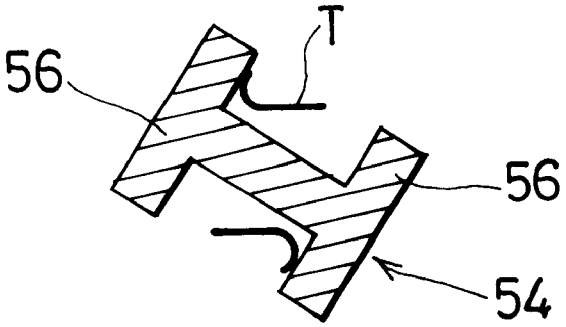
FIG. 8 PRIOR ART

A coating film transfer tool 105 of a sixth embodiment according to the present invention is illustrated in FIG. 6.

Also in the coating film transfer tool 105, the structure other than the piviot shaft 25 is essentially the same as in the first embodiment and so the description thereof will not be repeated.

In this embodiment, when viewed from the axis SA of the pivot shaft 25, the axis SC of the pressing transfer part 22 is shifted in parallel in the direction of the receiving surface.

In this respect, since the turning shaft 25 is joined to the transfer head 14 by a joint part 25' positioned at right angles to both axes SA and SC, the turning shaft 25 and the transfer head 14 are formed in the shape of a crank as a whole.

In this case, since both axes SA and SC are in parallel with each other, the resistance of the transfer head 14 to rotation is less in FIG. 5 than in FIG. 1, and hence the transfer head 14 is turned more smoothly.

Also in this embodiment, a distance P between the main body 125 and the receiving surface can be made larger as compared with the conventional coating film transfer tool. Therefore the portion S of the receiving surface ahead of the tip of part 22, in particular, the end position of transfer, can be easily checked.

In this respect, since the transfer head 14 can be turned in the preferred embodiments illustrated in FIG. 5 and FIG. 6, the main body that makes the checking of the end position of transfer difficult can be inclined when it is used to easily check the end position of transfer from the upper side. It is also possible to use a method by which as the end of transfer is approached, the main body is further inclined upwardly to easily check the end position of transfer.

Typical dimensions of the above-described coating film transfer tools 10, 101, 102, 103, 104 and 105, are as follows: the width B (FIG. 1(*c*)) in the direction of length of the pressing transfer part 22: 8 mm; the distance between the tape controlling members 30, 30 formed on the pressing transfer part 22: 5.3 mm; the rising angle $\theta$ (FIG 1(*d*)) of the tape controlling members 30, 30 to the transfer tape T: 30 degrees; the depth C (FIG 1(*b*)) of the pressing transfer part 22: 2.5 mm; and the height E of the tape controlling members 30, 30: 2.5 mm. A typical dimension for the width of the transfer tape T is 5 mm and the width of the main bodies 12, 121 is 9 mm.

The pivot shaft 20, 24 or 25 of the coating film transfer tool 10, 101 102, 103, 104, or 105 may be freely turned relative to the main body 12, 121, 122, 123, 124, or 125, or may be returned to the normal (untwisted) position by an elastic force.

In this respect, it is advisable that the turning angle be ±45 degrees.

As described above in the preferred embodiments, according to the present invention, just after the coating film is transferred to the receiving surface, the tape base material is prevented from moving in the direction of width thereof by the tape controlling members formed on both ends of the pressing transfer part in the lateral direction.

Further, since the tape controlling members are provided only on the pressing transfer part at the tip portion of the transfer head, even if the tape base material is twisted, it is not put into strong contact with the tape controlling members.

Further, since the tape controlling members are formed only on the side of the pressing transfer part where the tape base material is turned over and free of coating, they do not hinder the transfer operation.

Even if the turning shaft is turned to a large angle relative to the main body and the transfer tape is twisted thereby, the tape controlling members are put into contact only with the tape base material after the transfer operation. Therefore, they are not put into contact with the transfer tape coated with coating film before transfer and do not cause damage to the coating film. Therefore, this produces a good transfer operation.

Further, if the rising angle of the tape controlling member of the pressing transfer part to the transfer tape base material is made 20 to 90 degrees, even if the turning angle of the transfer head to the main body is made large, the transfer tape does not go over the tape controlling members and does not go off the transfer head, and hence does not hinder the checking of the transfer position.

Still further, if the main body is provided with a tape guide, the tape guide is not turned relative to the main body. Hence, the position of the tape in the lateral direction is always controlled within the fixed position of the tape guide. Therefore, this prevents the tape guide and tape controlling members from being put into forceful contact with the transfer tape so as not to hinder the running of the transfer tape.

Furthermore, if the pressing transfer part is shifted from the axis of the turning shaft toward the receiving surface, the distance between the main body and the receiving surface can be made large, so that the end position of the transfer can be easily checked.

Preferred embodiments of the invention have been described in considerable detail. Many modifications and variations will be apparent to those skilled in the art.

Therefore, the invention should not be limited to the embodiments described, but should be defined by the claims which follow.

What is claimed is:

1. In a coating film transfer tool comprising an unreeling rotary part and a reeling rotary part that are rotatably received in a main body, a transfer head having a pressing transfer part at an extending end thereof, a transfer tape of a length, width and thickness wound lengthwise on said unreeling rotary part and including a tape base material and coating film releasably adhered to said tape base material, said tape base material being wound upon said reeling part after being passed lengthwise over an application side of said pressing transfer part, past a separating edge of said pressing transfer part, and to a return side of said pressing transfer part, said separating edge being between said application side and said return side, said coating film being separated from said tape base material as it runs from said application side to said return side so as to be transferred to a receiving surface which faces said application side, the transfer head being pivotable about a pivot axis, the improvement wherein tape controlling members are provided only on the return side of the pressing transfer part with said tape base material between said tape controlling members, said tape controlling members extending from said return side in the direction of the thickness of said tape base material, and wherein said application side is free of members along edges of said tape which extend from said application side in the direction of the thickness of said tape.

2. A coating film transfer tool as claimed in claim 1, wherein an angle of from 20 to 90 degrees is between: a line from said separating edge to an edge of the tape controlling member which is distal from the tape base material in the direction of the thickness of the tape base material; and the tape base material.

3. A coating film transfer tool as claimed in claim 1, wherein the main body is provided with a tape guide for controlling the movement of the transfer tape in the direction of the width thereof.

4. A coating film transfer tool as claimed in claim 3, wherein the width of the pressing transfer part of the transfer head is larger than the width within which the tape guide controls the movement of the transfer tape and wherein the pressing transfer part protrudes from the tape guides.

5. A coating film transfer tool as claimed in claim 3, wherein the tape guide is removably provided on the main body.

6. A coating film transfer tool as claimed in claim 3, wherein the tape guide is transparent.

7. A coating film transfer tool as claimed in claim 1, wherein the pressing transfer part is shifted from the axis of the pivot shaft in the direction of the receiving surface.

8. A coating film transfer tool as claimed in claim 7, wherein an axis of the pressing transfer part is inclined to the axis of the pivot shaft.

9. A coating film transfer tool as claimed in claim 7, wherein the pressing transfer part is parallel to the axis of the pivot shaft.

10. In a coating film transfer tool comprising an unreeling rotary part and a reeling rotary part that are rotatably received in a main body, a transfer head having a pressing transfer part at an extending end thereof, a transfer tape of a length, width and thickness wound lengthwise on said unreeling rotary part and including a tape base material and coating film releasably adhered to said tape base material, said tape base material being wound upon said reeling part after being passed lengthwise over an application side of said pressing transfer part, past a separating edge of said pressing transfer part, and to a return side of said pressing transfer part, said separating edge being at a distal end of said pressing transfer part between said application side and said return side, said coating film being separated from said tape base material as it runs from said application side to said return side so as to be transferred to a receiving surface which faces said application side, the transfer head being pivotable about a pivot axis, the improvement wherein tape controlling members are provided only on the return side of the pressing transfer part with said tape base material between said tape controlling members, said tape controlling members extending from said return side in the direction of the thickness of said tape base material and being positioned at the distal end of the pressing transfer part, and wherein said application side is free of members along edges of said tape which extend from said application side in the direction of the thickness of said tape.

* * * * *